United States Patent [19]

Carlson

[11] 4,337,670

[45] Jul. 6, 1982

[54] YIELDABLE MULTI-FUNCTION LINKAGE APPARATUS FOR POWERED PIVOTING LOADS

[75] Inventor: Ronald R. Carlson, Excelsior, Minn.

[73] Assignee: Sico Incorporated, Minneapolis, Minn.

[21] Appl. No.: 81,178

[22] Filed: Oct. 2, 1979

[51] Int. Cl.[3] ..... F16H 21/44; A47C 19/06

[52] U.S. Cl. ..... 74/96; 74/99 R; 74/625; 5/136; 5/164 R; 49/139; 49/340; 108/7; 108/20; 248/292.1

[58] Field of Search ..... 5/131, 133 R, 133 B, 5/136, 164 R; 49/139, 340; 108/20, 48, 7; 74/96, 99 R, 101, 102, 625; 248/123.1, 240.1, 240.4, 280.1, 292.1

[56] References Cited

U.S. PATENT DOCUMENTS

| | | | |
|---|---|---|---|
| 276,546 | 4/1883 | Woodruff | 5/164 R |
| 512,184 | 1/1894 | Woodruff | 5/164 R |
| 956,340 | 4/1910 | Haley | 5/164 R |
| 1,269,545 | 6/1918 | Mengedoht | 49/340 |
| 1,380,502 | 6/1921 | Sinclair | 5/164 R |
| 1,945,826 | 2/1934 | Sinclair | 5/164 R |
| 2,038,410 | 4/1936 | Bridenbaugh | 5/133 |
| 2,067,136 | 1/1937 | Bridenbaugh | 5/164 R |
| 2,325,775 | 8/1943 | Horton | 49/139 |
| 2,621,543 | 12/1952 | Rossman | 74/625 |
| 2,665,904 | 1/1954 | Lehmann | 74/625 |
| 2,694,320 | 11/1954 | Kron | 74/625 |
| 2,779,032 | 1/1957 | Van Der Sluys | 5/164 R |
| 2,932,978 | 4/1960 | Newberry | 74/625 |
| 3,550,167 | 12/1970 | Bennett | 5/164 R |
| 3,828,375 | 8/1974 | Driver | 5/164 R |
| 3,999,245 | 12/1976 | Bue et al. | 16/128 R |

FOREIGN PATENT DOCUMENTS

| | | | |
|---|---|---|---|
| 710157 | 6/1931 | France | 5/164 R |
| 1255090 | 1/1961 | France | 5/136 |
| 1548563 | 7/1979 | United Kingdom | 49/139 |

OTHER PUBLICATIONS

"Sico Bed & Table System", Sico Inc. Catalog.

Pascuzzo, "Isolation Valve Drive", IBM Technical Disclosure Bulletin, vol. 22, No. 11, p. 5028, Apr. 1980.

*Primary Examiner*—Lawrence J. Staab

*Attorney, Agent, or Firm*—Merchant, Gould, Smith, Welter & Schmidt

[57] ABSTRACT

A support structure (10), preferably a rotatable bed, pivotable between a generally horizontal use position and a generally vertical storage position is disclosed. A counterbalancing mechanism (20) which reduces the amount of force needed to rotate the support structure (10) is operatively connected to the support structure (10). A drive arm (70) driven by a motor mechanism (64) in a linear direction is also operatively connected to the support structure (10). The drive arm (70) is connected to the support structure (10) through a linkage apparatus. The linkage apparatus has linkage plates (82) pivotably connected to drive arm (70) and connecting plates (92) extending from the support structure (10). A T-shaped rod mechanism (102) is engaged by latch (116), rotatably connected to the linkage plates (82), and extends through a hole in frame member (14) of support structure (10) where a coil spring (124) is received about the rod mechanism (102). The support structure (10) may be power rotated or manually rotated depending on whether the latch (116) is engaged or disengaged, respectively. Coil spring (124) allows movement of the support structure (10) relative to the drive arm (70) if an extraordinary force acts on the support structure (10).

29 Claims, 8 Drawing Figures

10
12
14
16
20
22
24
26
28
30
32
34
36
38
40
42
46
48
50
52
54
56
58
60
62
64
66
68
70
71
72
74
76
78
80
82
86
88
92
96
98
102
108
116
120
122
124
126
150
151
152
3
6

YIELDABLE MULTI-FUNCTION LINKAGE APPARATUS FOR POWERED PIVOTING LOADS

TECHNICAL FIELD OF THE INVENTION

This invention relates to pivotable loads or support structures, such as wall-type beds, tables, or other pieces of furniture. More particularly, the invention relates to the linkage apparatus between a pivotable wall-type bed and a powered drive mechanism therefor.

BACKGROUND OF THE PRIOR ART

Numerous types of pivotable wall beds, desks, tables and other pieces of furniture are known in the prior art and are widely used in situations in which available space is at a premium. The bed or other piece of furniture is provided with hinges so that it can be pivoted upwards from its generally horizontal-use position to a generally vertical storage position adjacent a wall or in a small closet placed in a wall for that purpose.

Since the weight of even a medium-sized wall bed can be considerable, counterbalance springs have long been used to make it easier for a person to move the bed between the in-use and storage positions. The same situation exists with respect to all types of pivoting loads, including, but not limited to, fold-up desks, tables, work counters, loading ramps or doors hinged at the bottom, or any member pivoted near the bottom for movement between a generally vertical to a generally horizontal position. For purposes of illustration, the invention disclosed herein is applied to a pivotable wall-type bed, but it will be understood that the present invention is equally applicable to any of the pivoting type loads discussed above.

While a counterbalance mechanism can greatly reduce the amount of force needed to move a rotatable wall-type bed between its use and storage positions, the application of a small force can still be burdensome to some persons. The invention disclosed in U.S. patent application Ser. No. 99,655 to K. Wilson and R. Bue, the disclosure of which is incorporated herein, is directed to a power operated rotatable support structure. A motor means is shown assisting a counterbalance means in providing the force required to move a support structure between its horizontal and vertical dispositions. The motor means is comprised of an electric drive motor which drives a reciprocal drive arm in a generally linear direction. The drive arm is coupled through at least one linkage arm to the support member. The linkage arm is pivotable at its point of connection to the drive arm and also at its point of connection to the support member. In order to transfer the linear motion of the drive arm to pivoting motion of the support member, a means for yieldably holding a linkage arm relative to the support member is provided. Several embodiments of the holding means are shown. None of the holding means disclosures in this patent application provides for both a yieldable connection between the drive arm and the support member combined with an automatic disengagement of the rotational linkage between the drive arm and the support member with subsequent automatic reengagement. Thus, the various prior art systems provide for either a manually operated rotatable bed having a counterbalance means or for a power assisted rotatable bed having a motor means in addition to a counterbalance means. The prior art, however, does not show any mechanism which can provide both features.

SUMMARY OF THE INVENTION

The present invention is directed to a power operated rotatable support structure wherein a support member is movable between a generally vertical disposition and a generally horizontal disposition. A counterbalance means is operatively connected to the support member for reducing the amount of force needed to move the support member between its horizontal and vertical dispositions. A motor means is also operatively connected to the support member and provides the additional force required to move the support member between the horizontal and vertical orientations. In a preferred embodiment, the support structure is in the form of a rotatable bed movable between a horizontal use position and a vertical storage position. The motor means is comprised of an electric drive motor which drives a reciprocal drive arm in a generally linear direction. The drive arm is coupled through a linkage apparatus to the support member. The linkage apparatus is pivotable at its point of connection to the drive arm and also at an internal point, the portion of the linkage apparatus between the referenced internal point and the support member being fixedly attached to the support member.

The linkage apparatus is comprised essentially of a plate structure which is fixedly fastened to the support member, a linking plate structure which at one end is rotatably fastened to the drive arm and at the other end is rotatably fastened to the fixed plate structure, and a yieldable latch mechanism. The latch mechanism includes a T-shaped structure made from rods and other parts. The base of the T extends through a hole in the fixed plate structure and the support member. On the side opposite the linkage apparatus, a coil spring is held in place on the protruding rod. The cross portion of the T-shaped structure is engaged by a rotatable latch member which is rotatably attached to the rotatable plate structure. As the bed is power driven from its horizontal use position to its vertical storage position the rotatable latch member falls away from the T-shaped structure when the bed is near its vertical storage position. In this configuration, the linkage apparatus allows for a person to manually lower, as well as power drive, the rotatable bed to its horizontal use position. If the bed is manually lowered, it may also be manually elevated. If the bed is power driven to its horizontal use position or if the motor means is actuated subsequent to a manual lowering, the latch falls into place about the T-shaped structure placing the linkage apparatus in a configuration allowing for a power-assisted return of the bed to its elevated storage position.

Various advantages and features of novelty which characterize the invention are pointed out with particularity hereafter. For a better understanding of the invention, its advantages, and objects attained by its use, reference should be had to the drawings which form a further part hereof, and to the accompanying descriptive matter, in which there are illustrated and described preferred embodiments of the invention.

DETAILED DESCRIPTION OF THE INVENTION

Figures 1, 2:
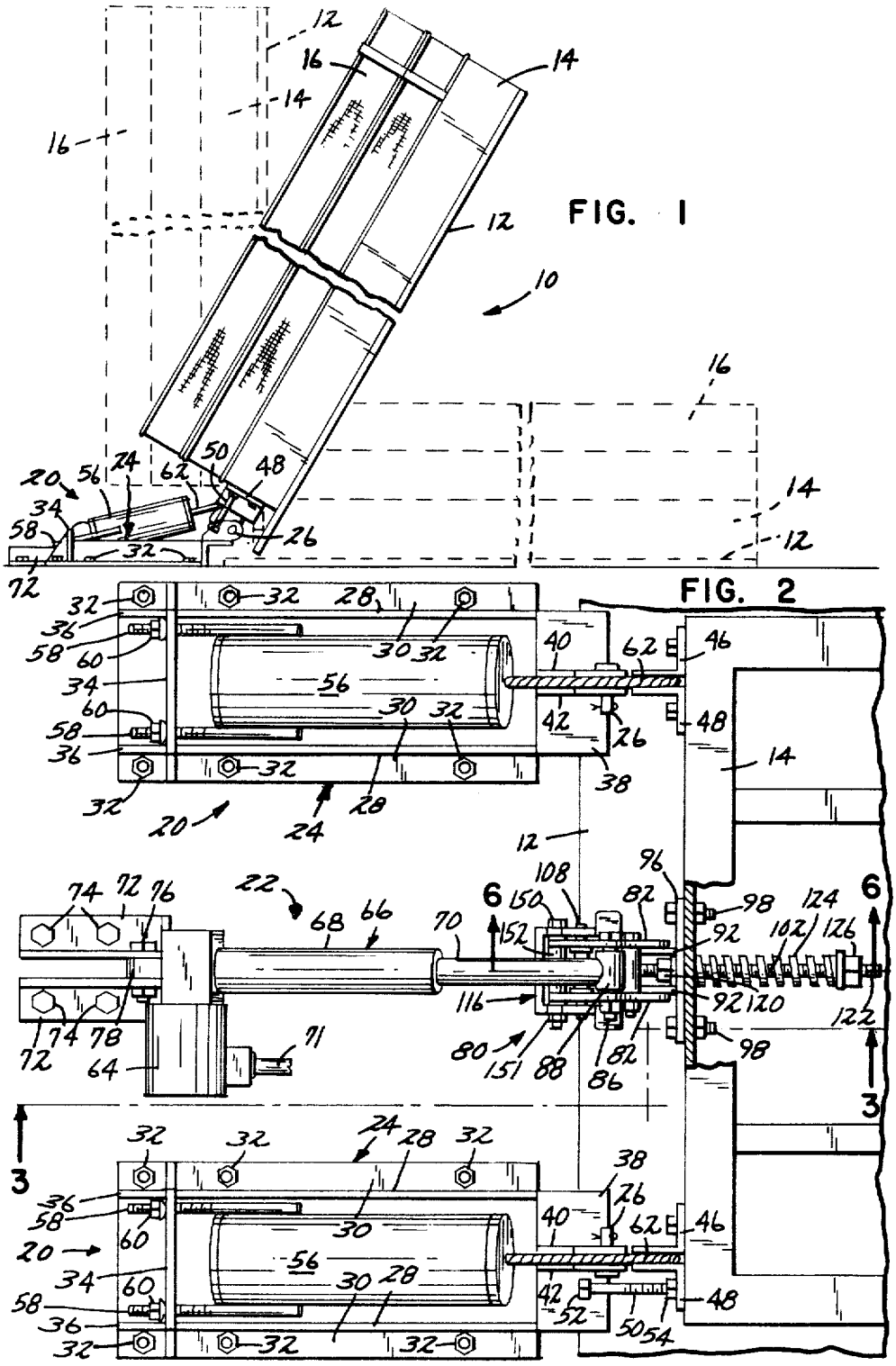
FIG. 1 is a side elevational view of the rotatable support structure illustrating generally a rotatable bed in an intermediate position between the vertical storage position and the horizontal use position, the latter positions shown in phantom lines.
FIG. 2 is a top view, partially broken away, of a rotatable support structure showing the counterbalance mechanisms and the drive mechanism as attached to a portion of a support structure.
Figure 8:
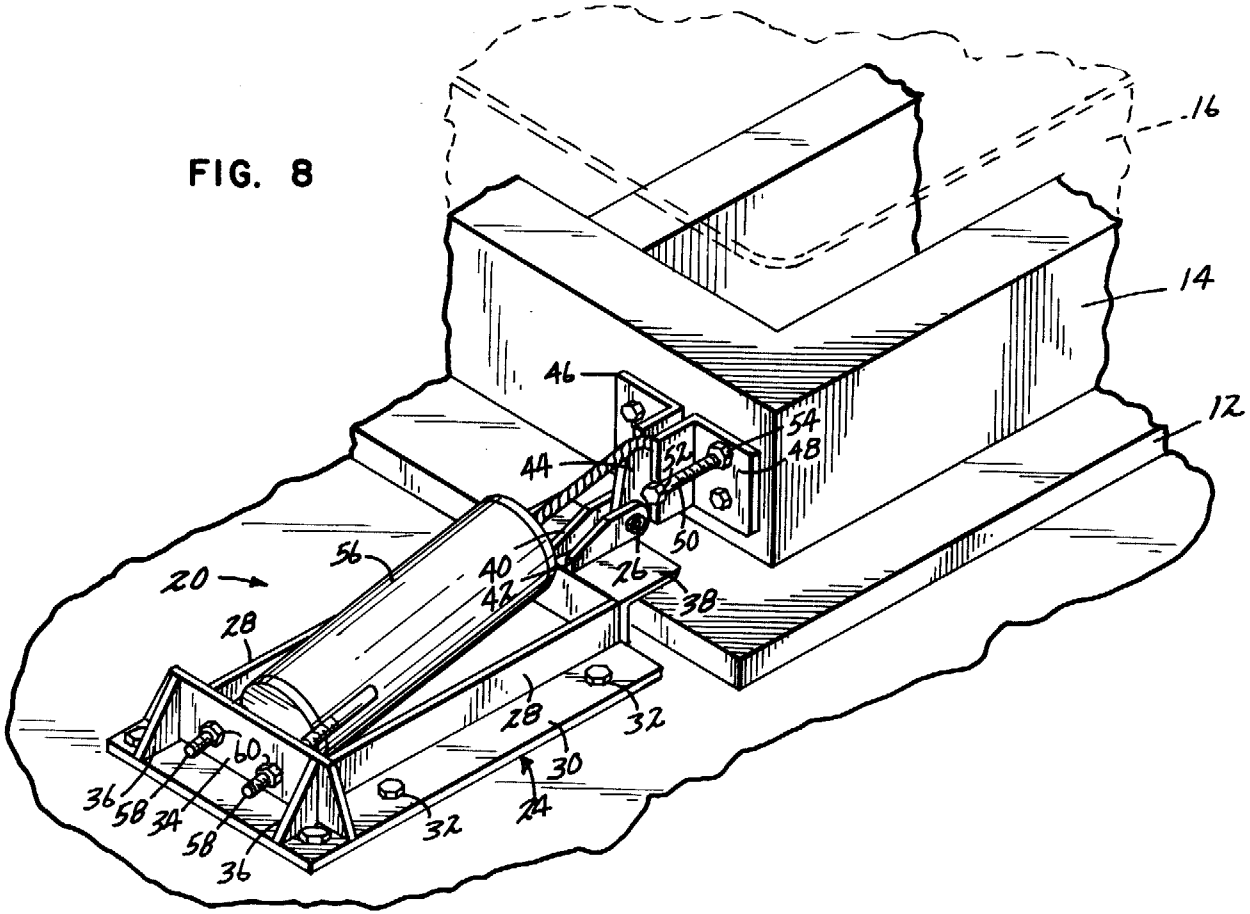
FIG. 8 is a perspective view of the rotatable support structure showing the counterbalancing mechanism.

Referring to the drawings in detail, wherein like numerals indicate like elements, there is illustrated in FIG. 1 a foldable or pivotable support structure designated generally as 10. The support structure 10 is illustrated in FIGS. 1 and 8 as being comprised of a folding bed having a generally planar support platform or member 12, a frame member 14 extending perpendicularly therefrom and a mattress or other bedding 16 supported within the frame member 14. The base portion of frame member 14 is connected for pivotal motion between a generally horizontal and a generally vertical position by means of a hinge mechanism. A counterbalance mechanism 20 is coupled to the hinge mechanism to reduce the amount of force necessary to pivot the support member 12 between the horizontal and vertical positions. A motor mechanism 22 shown in FIG. 2 can provide the force or power to move the support member 12 between the vertical and horizontal dispositions.

The frame member 14 and the support member 12 pivot relative to a stationary base frame member 24 about a hinge pin 26. Base frame member 24 is adapted to be rigidly secured to the floor or to any suitable reinforcing member which is installed on the floor. The base frame member 24 preferably has vertical side rail portions 28 for strength and rigidity and flange portions 30 which are used for securing the base frame member 24 to the floor by means of nut and bolt assemblies 32. Base frame member 24 also includes a vertical end plate 34 and suitable braces 36 which interconnect flange portion 30 and vertical end plate 34. Base frame member 24 can be cast, or can be welded from individual angle iron members, as may be desired.

At the forward end of base member 24 there is provided a shelf portion 38, which in the embodiment shown is parallel to the floor, but spaced apart therefrom. A pair of guide plates 40, 42 are welded to the shelf portion 38. The guide plates 40 and 42 are mounted in a vertical orientation, and spaced apart from each other so as to accommodate a cam member 44. The hinge pin 26 passes through holes in the guide plates 40, 42 and through an opening provided in the cam member 44 so that the cam member 44 is free to pivot thereabout. Angle members 46, 48 are welded to the sides of the cam member 44. Alternatively, the cam member 44 and angle members 46, 48 could be made from a single casting if desired. The angle members 46, 48 are fixedly connected to the frame member 14 to form a movable portion of the support structure together with the support member 12.

A stop member is provided which comprises a bolt 50 which is threaded into a tapped hole provided in the angle member 48. When the support platform 12 is moved to its vertical position the head 52 of the bolt 50 engages the shelf portion 38 of the base frame member 24. This serves to limit the vertical motion of the support platform 12. The stop is adjustable by turning the head 52 of the bolt 50 to be threaded into or out from the angle member 48. A lock nut 54 may then be used to lock the stop in the desired position.

A cylindrical shaped spring housing 56 has a pair of anchor bolts 58 welded to the outside periphery thereof for securing the spring housing 56 to the base frame member 24, and for providing adjustment therefor. The anchor bolts 58 pass through holes provided in the vertical end plate 34 and are secured by nuts and washers 60, which aid in allowing slight adjustments in the position of the spring housing 56 as the hinge is pivoted. A coil spring (not shown) is provided within the spring housing 56. A cable 62 has a first end operatively connected to the spring and passes outwardly from one end of the spring housing 56. Cable 62 then wraps over and around cam member 44, where its other end engages and is attached to the frame member 14. The cable 62 is also held in place on the cam surface by the angle members 46, 48. The force of the spring operating through the cable 62, and the cam plate 44 provides a counterbalancing force to the support platform 12. Additional details of the counterbalancing mechanism 20 can be found in U.S. Pat. No. 3,999,245, the disclosure of which is incorporated herein.

With the amount of force required to pivot the support platform 12, attached frame member 14 and bedding 16 reduced by means of the counterbalance mechanism 20, the motor mechanism 22 need provide only a small amount of force. The motor mechanism 22 includes a low power electric motor 64 which drives a conventional traveling screw having an extendable arm indicated generally as 66. The electric motor is preferably a low powered motor. The electric motor 64 and the extendable arm mechanism 66 are of conventional design and hence will not be described in detail. A Ball Screw Actuator of Motion Systems Corporation has been found suitable. The extendable arm mechanism 66 includes a cylinder 68 and a reciprocable drive arm 70. A pair of angle members 72 are attached to the floor, or to any suitable reinforcing member which may be installed on the floor by bolts 74. The electric motor 64 and the extendable arm mechanism 66 are pivotably connected to the angle members 72, 74 by a bolt assembly 76. A pin or extension 78 extends from the lowermost end of the extendable arm assembly 66 and has a hole extending through it. The extension 78 is received between upright flanges of angle members 72, 74 and bolt 76 passes through the hole in the upright flanges and extension 78 to pivotably attach the electric motor 64 and the extendable arm assembly 66 with respect to the floor.

Figure 6:
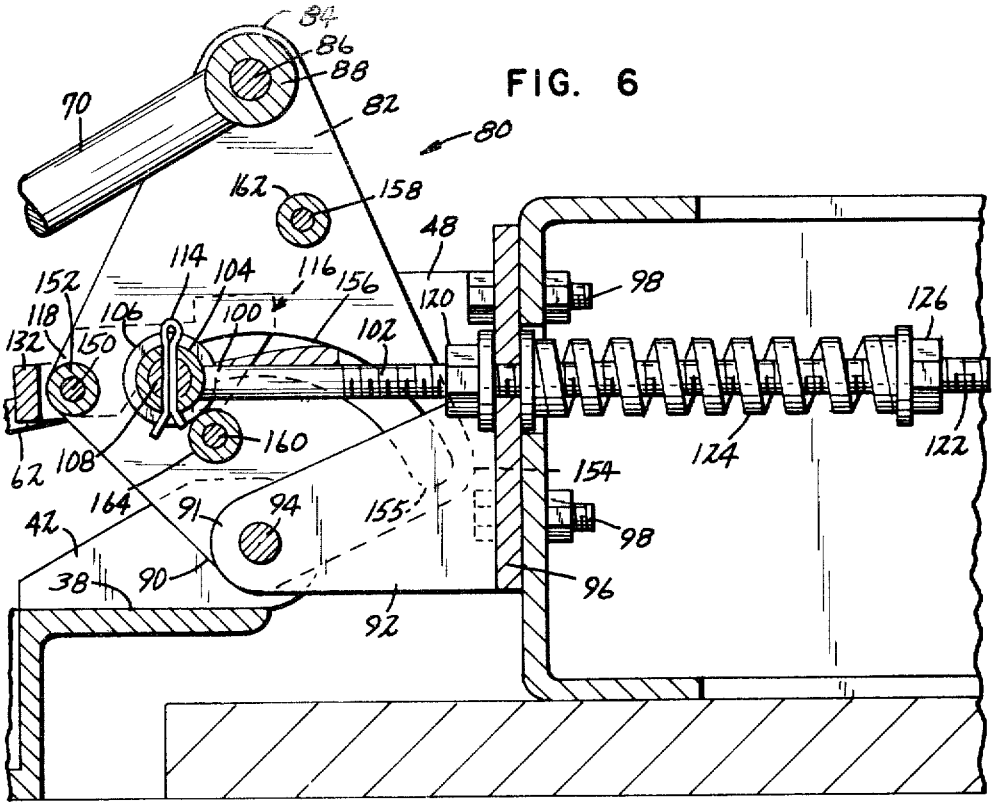
FIG. 6 is a cross sectional view, on an enlarged scale, of the linkage apparatus taken along line 6—6 of FIG. 2.

The electric motor 64 drives the reciprocal drive arm 70 in and out of the cylinder 68. The motor 64 is connected to a power source and control switch through conductor wires 71. The control switch is preferably the type which must be continually depressed to supply current to the motor. As shown in FIG. 6, a linkage assembly, designated generally as 80, operatively couples arm 70 to support member 12. A pair of quadrilateral linkage plates 82 are connected between a free end 88 of the arm 70 and the frame member 14. A top corner 84 of each linkage plate 82 is pivotably connected by means of a pin or bolt 86 to the free end 88 of the arm 70. An opposite corner 90 of each linkage plate 82 is connected to a substantially triangular pair of connecting plates 92 by a bolt or pin 94. The connecting plates 92 are spaced apart and extend outwardly from an attachment plate 96 which is secured to the frame member 14 by a plurality of bolt and nut assemblies 98. The bolts 94, secured by nuts 95, pass through holes in the apex corner 91 of connecting plates 92 and in the lower corner 90 of linkage plates 82, linkage plates 82 being located to the outside of the respective connecting plates 92.

Figure 7:
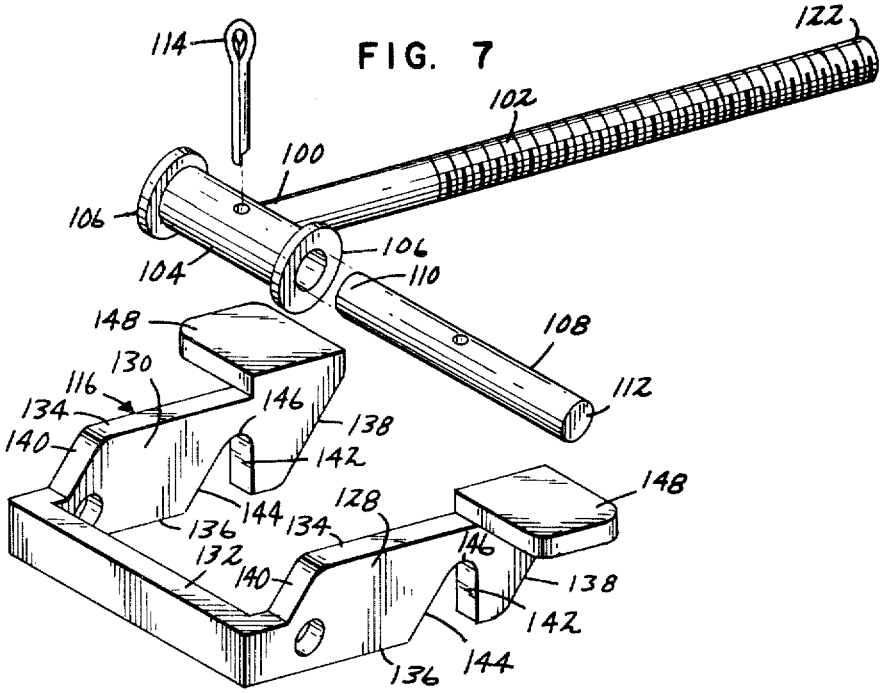
FIG. 7 is an exploded view of several of the components which comprise the latch mechanism of the linkage apparatus.

The end 88 of the arm 70 is thus rotatably connected about the bolt 86 and the linkage plates 82 are rotatably connected about the bolts 86 and 94. In order to transfer the motion of the arm 70 to pivotable motion of the support member 12, a means must be provided for holding the linkage plates 82 in position relative to the frame member 14 and the support member 12 during the motion of the drive arm 70. Otherwise, the linkage plates 82 would merely pivot with respect to the frame member 14. A rod and latch mechanism hold the linkage plates 82 in position relative to the frame member 14 and the support member 12 during such driving motion of the arm 70. See FIGS. 6 and 7. A first end 100 of a connecting rod 102 is connected to a cylindrical spacer 104 having flanges 106 at its ends. The cylindrical spacer 104 is connected to a cross rod 108 at a point intermediate its ends 110, 112 by means of a bolt or cotter pin 114 which passes through holes in the cross rod 108 and the cylindrical spacer 104. A latch member 116 is rotatably connected to linkage plates 82 at corners 118 farthest from frame member 14 and engages cross rod 108 holding linkage plates 82 in place relative to frame member 14 and support member 12 during powered retracting motion of the platform 12, as will be explained more fully hereinafter.

From its first end 100 the rod 102 extends away from the cylindrical spacer 104 toward the frame member 14. A nut 120 is threaded onto rod 102. Rod 102 passes through a hole in the attachment plate 96 and a hole in the frame member 14 to a side of the frame member 14 opposite the side of the frame member 14 on which the linkage plates 82 are disposed. On this second side, the rod 102 extends a distance to its free second end 122. The coil spring 124 is received about the portion of the rod 102 which extends on the side of the frame member 14 which is opposite the linkage plates 82. A nut 126 is threaded onto the end 122 of the rod 102. Nuts 120 and 126 position the spring 124 against the surface of the frame member 14 and relative to cross rod 108 and latch 116. In this manner, the linkage plates 82 are held in the position shown in FIG. 6. If the rod 102 were fixedly secured to the frame member 14 and the latch member 116 engaged about pin 108, motion would be transmitted between the arm 70 and the support member 12 irrespective of the forces present. However, rod 102 is held in position by the force of the spring 124. Thus, whenever an external force overcomes the spring constant, the spring 124 will compress and allow relative motion of the support member 12 clockwise from the linkage plates 82.

Nuts 120 and 126 are also useful for adjusting the lowest possible horizontal position of support structure 10. By adjusting nuts 120 and 126 toward the end 122 of rod 102, whereby spring 124 and attachment plate 95 also move toward the end 122 of rod 102, the lowest possible horizontal position of support structure 10 is lower or has moved clockwise relative to linkage plates 82. Correspondingly, by adjusting nuts 120 and 126, and consequently, spring 124 and attachment plate 96, away from the end 122 of rod 102, the lowest possible horizontal position of support structure 10 moves counterclockwise relative to the linkage plates 82 and tends to allow the end of the support structure 10 farthest from the linkage apparatus to "float" or weigh less heavily on the floor.

Latch 116 is shaped to accomplish a number of functions. Latch 116 is comprised of two side plates 128, 130 held in a spaced apart relationship by end plate 132. End plate 132 is welded at one end to side plate 128 and at the other end to side plate 130. Alternatively, latch 116 could be cast in one piece. The side plates 128, 130 are configured alike and, hence, only plate 128 will be described in detail with like portions being indicated by like numerals. The upper edge 134 and lower edge 136 of side plate 128 are parallel. The lower portion of forward edge 138, that is the edge away from end plate 132, is cut at an approximately 45 degree angle from a line extended from lower edge 136. The upper portion of rear edge 140 is parallel to forward edge 138. The lower portion of rear edge 140 is perpendicular to lower edge 136 and abuts end plate 132. A notch is cut in the forward portion of the lower edge 136. The height of the notch is approximately one-half the thickness of side plate 128. The forward edge 142 of the notch is perpendicular to lower edge 136. The rearward edge 144 of the notch slopes rearward approximately 15 degrees from the vertical. The top 146 of the notch has a radius slightly larger than the radius of cross rod 112 and meets tangentially forward notch edge 142 and rearward notch edge 144. A substantially square plate 148 is welded perpendicularly, or alternatively cast, to side plates 128, 130 at the forward portion of the upper edge 134. Each edge of square plate 148 is approximately three-fourths the width of side plates 128, 130. A bolt 150, secured by nut 151, passes through holes in the lower, rearward portions of side plates 128, 130 and corresponding holes in corner 118 of linkage plates 82. Bolt 150 is sufficiently loose to allow latch 116 to move rotationally relative to linkage plates 82. A cylindrical spacer 152 is also received about bolt 150 between the opposing linkage plates 82.

As indicated previously, linkage plates 82 have a quadrilateral shape. Corner 118, farthest from frame member 14 as shown in FIG. 6, is approximately located on a horizontal with rod 102. Bottom corner 90 is located to match with the apex corner 91 of triangular connecting plates 92. Top corner 84 is located to match the end of drive arm 70 when it is fully extended. A circular slot 156 is formed in each plate 82. Corner 154 is located to accomodate one end 155 of the circular slot 156. The circular slot 156 is centered on the center of bolt 94 and has a width slightly larger than the diameter of cross rod 108. Another end 157 of slot 156 farthest from frame member 14 is located to accept and contact cross rod 108 when support platform 12 is motor driven to its horizontal position (see FIG. 3). When the arm 70 is driven from the retracted position shown in FIG. 4 to the extended position shown in FIG. 6, the end 157 contacts and pushes against the cross rod 108 to transmit motion to the support platform 12. The end 155 of slot 156 nearest frame member 14 is located to accept cross rod 108 when support platform 12 is manually placed in its horizontal position (see FIG. 5). That is, the arc of slot 156 is a sufficient distance and the end 155 is located to allow the support platform 12 to be pulled manually to the horizontal position by allowing cross rod 108 to slide in the slot 156. Linkage plates 82 are held in a spaced apart relationship by bolt assembly 158 located in the upper portion of plates 82 and bolt assembly 160 located in the lower portion of plates 82, as well as bolt assembly 150, previously described. Lower bolt assembly 160 is further located to contact the lower, forward edge 136 of side plates 128, 130 of latch 116 to hold it so cross rod 108 is engaged withn the notch but does not contact the top 146 of the notch. Cylindrical spacers 162, 164 are received about each of bolt assemblies 158, 160 between opposing linkage plates 82. Spacers 152, 162, and 164 are sufficiently long to hold linkage plates 82 outside spaced apart connecting plates 92. Each bolt assembly 158, 160 is comprised of a nut and bolt.

The operation of the counterbalancing mechanism and the motor mechanism 22 are described above. More detailed description may be found in U.S. Pat. No. 3,999,245 and U.S. patent application Ser. No. 99,655, both of which have been hereinbefore incorporated by reference.

The operation of the linkage apparatus relative to the drive arm mechanism 66 and the support structure 10 is best understood by reference to FIGS. 1, 3, 4 and 5. More particularly, referring to FIG. 4, support structure 10 is shown in the vertical storage position. In that position drive arm 70 is retracted within cylinder 68 and latch 116 is fallen away from cross rod 108. Latch 116 is rotated away from cross rod 108 to the point where the lower edge of end plate 132 contacts linkage plates 82.

From the vertical storage position, the support structure 10 may be either power driven to the horizontal use position or manually lowered to the horizontal use position (see FIG. 1). If the support structure 10 is power driven, motor 64 drives arm 70 from its retracted to its extended position. During this driving motion, the plates 82 are pivoted in a clockwise direction and the ends 157 contact the cross rod 108 to transfer the pivoting motion of the plates 82 to pivoting motion of the support platform 12. Latch 116 rotates downward to engage cross rod 108 as the support structure 10 approaches the horizontal. In this manner, the rod 70 is coupled to the cross-rod 108 for powered retraction of the support platform 12. Linkage plates 82 are held in a fixed position relative to frame member 14 during the rotational movement since cross rod 108 contacts and pushes against the rearward end 157 of slot 156 in linkage plates 82 (see FIG. 6).

Figure 3:
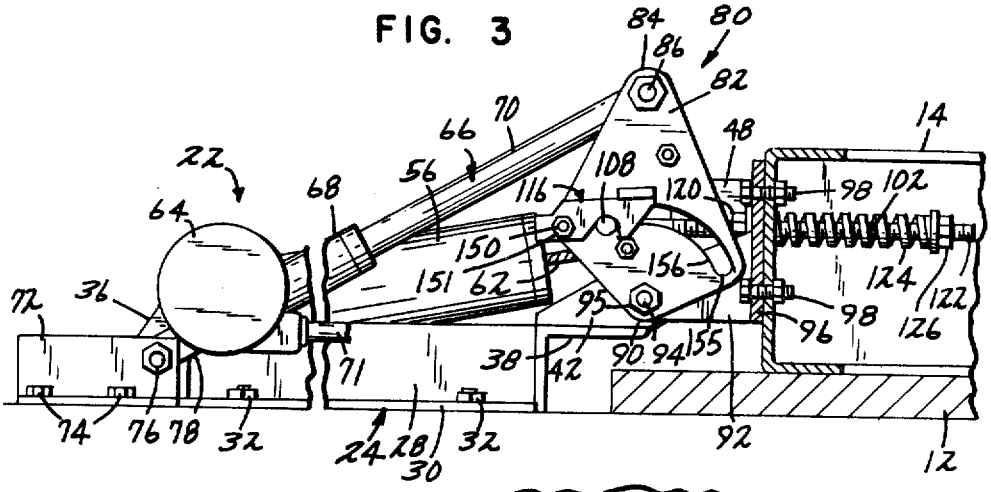
FIG. 3 is a side elevational view of the drive mechanism, taken along line 3—3 of FIG. 2, showing the linkage mechanism after the support structure has been power driven to its horizontal use position.

Referring to FIG. 3, with latch 116 engaging cross rod 108, the linkage apparatus is configured to be power driven upward to the vertical storage position. As this occurs, cross rod 108 contacts and pulls against the forward edge 142 of the notch in latch 116 holding linkage plates 82 in a fixed position relative to frame member 14. When the support platform is approximately 30 degrees from the vertical, or equivalently attachment plate 96 is approximately 30 degrees from the horizontal, the center of gravity of the support platform 12, frame member 14 and mattress and other bedding 16 passes vertically over the rotational axis manifested by bolt 94. At that point, power is no longer needed to complete the rotational movement to the vertical storage position. Rather, gravitational force acting along a moment arm from the rotational axis to the center of gravity acts to torque the support structure along the remainder of its rotational travel. As the support structure falls toward the vertical, cross rod 108 releases from its contact with the forward edge 142 of the notch in side plates 128, 130 of the latch 116. The location of the center of gravity of the latch 116 relative to its rotational axis at that point provides torque to rotate the latch 116 from engagement with cross rod 108.

During powered rotational movement, situations may occur where an excessive external force acts on the support structure, for example, a box of books may be resting on the end of a folding bed when the motor mechanism is inadvertently started. In such situations frame member 14 can move relative to the drive arm mechanism 66 by compressing spring 124. If an excessive downward force is applied to the platform, spring 124 is compressed and extraordinary stress to other components in the linkage apparatus or drive mechanism 66 is avoided. If the excessive force continues to act after spring 124 has been fully compressed, then, with cross rod 108 made from a material having a lower yield strength in the preferred embodiment than other components in the linkage apparatus or drive mechanism 66, cross rod 108 yields, that is bends or breaks, and again other system components are saved from extraordinary stress. A deformed cross rod 108 is easily replaced by removing pin 114 (see FIG. 7), replacing deformed cross rod 108 with a new one within cylinder 104, and reinstalling pin 114. The capability of the cross-rod 108 to bend or break also protects the other components of the system if excessive force is applied in an upward or counter-clockwise direction on the platform 12.

Figure 4:
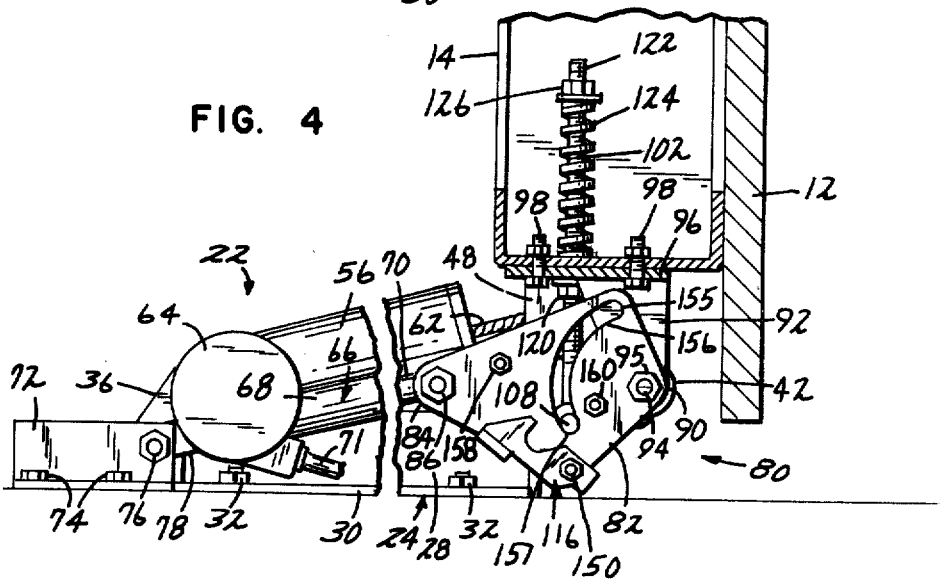
FIG. 4 is a side elevational view of the drive mechanism similar to FIG. 3 showing the linkage apparatus with the support structure in its vertical storage position.
Figure 5:
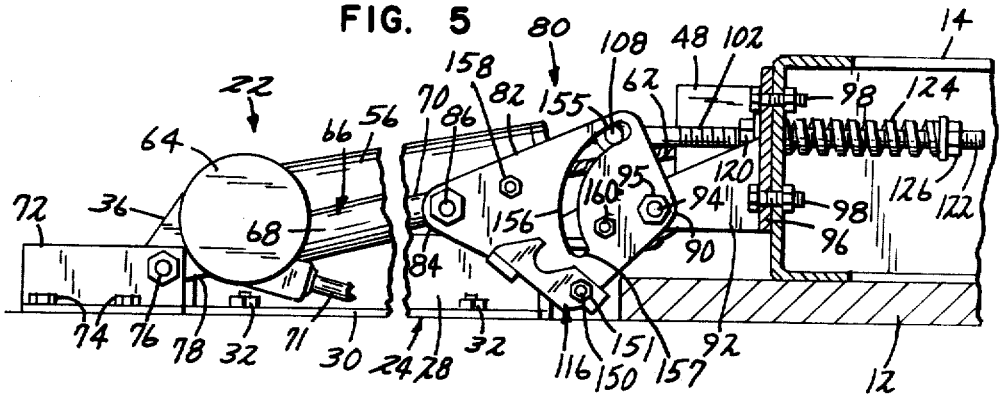
FIG. 5 is a side elevational view of the drive mechanism similar to FIGS. 3 and 4 showing the linkage apparatus after the support structure has been manually lowered to its horizontal use position.

From the vertical storage position shown in FIG. 4, support structure 10 may also be manually placed in the horizontal use position as shown in FIG. 5. During manually driven rotational movement, the drive mechanism 66 and linkage plates 82 do not move. Rather all linkage apparatus components fixedly attached to frame member 14 rotate with the support structure 10. Significantly, latch 116 remains unengaged from cross rod 108 thereby allowing cross rod 108 to track from one end of slot 156 in linkage plates 82 to the other end.

When support structure 10 has been manually driven to the horizontal use position, it may be either manually or power returned to the vertical storage position. If it is manually returned, cross rod 108 simply retracks along slot 156 in linkage plates 82 from one end of the slot 156 to the other. If it is power returned, drive arm 70 must first be extended, linkage plates 82 rotated, and latch 116 reengaged onto cross rod 108. As the drive arm 70 is being extended, latch 116 drops or rotates in a clockwise direction and the forward slanted edge 138 and forward bottom edge 136 act as a camming surface and guide the latch 116 upward and over the cross rod 108. The notch of the latch 116 then falls into engagement about the cross-rod 108. If the latch 116 should fall prematurely, i.e., before edges 138 can contact the cross-rod 108, bolt 160 acts as a stop to prevent further clockwise rotation of the latch 116. The bolt 160 holds the latch 116 in such a position that further driving of the rod 70 causes the edges 138 to contact cross rod 108. Upon impact with cross rod 108, latch 116 is forced upward, over, and onto cross rod 108 as cross rod 108 tracks along the forward edge 138 and forward bottom edge 136 camming surfaces of latch 116. Once latch 116 engages cross rod 108, the support structure 10 can be power driven to a vertical storage position as previously described.

Numerous characteristics and advantages of the invention have been set forth in the foregoing description, together with details of the structure and function of the invention. The disclosure, however, is illustrative only, and it is therefore to be understood that changes may be made in detail, especially in matters of shape, size and arrangement of parts, within the principle of the invention, to the full extent of the terms in which the appended claims are expressed.

What is claimed is:

1. A yieldable multi-function linkage apparatus for connecting a powered drive arm and a rotatable structure rotatable between first and second end positions comprising:

a fixed connecting plate connected to the rotatable structure for rotation therewith;

a movable connecting plate rotatably attached to said fixed connecting plate for attachment to the powered drive arm; and holding means for yieldably and releasably connecting the rotatable structure and the movable connecting plate, said holding means enabling said drive arm to be driven without transferring the motion of said rotatable structure to said drive arm when force in excess of the force required to move said rotatable structure acts on said rotatable structure, said holding means disengaging rotationally said drive arm from said rotatable structure when the rotatable structure is rotated to one of its end positions whereby the rotatable structure can be rotated completely independent of the drive arm.

2. A yieldable multi-function linkage apparatus in accordance with claim 1 wherein said holding means includes a lock means for engaging and disengaging the drive arm to the rotatable structure, said lock means having position one wherein the drive arm is yieldably connected to the rotatable structure and a position two wherein the drive arm is uncoupled from the rotatable structure.

3. A yieldable multi-function linkage apparatus in accordance with claim 2 wherein said holding means further includes a first rod having a first end connected to a second rod, said first rod extending from its first end through a hole in a portion of the rotatable structure, and includes a biasing means for yieldingly allowing the rotatable structure to move relative to the drive arm and said rod when excessive force acts on said rotatable structure, and wherein said lock means includes a latch means for engaging said second rod when said lock means is in position one and for disengaging said second rod when said lock means is in position two.

4. A yieldable multi-function linkage apparatus in accordance with claim 3 wherein said movable connecting plate has a slot formed through it and a portion of said second rod passes through said slot, said slot having a first end and a second end, said second end being disposed further from the rotatable structure than said first end.

5. A yieldable multi-function linkage apparatus in accordance with claim 4 wherein the rotatable structure is rotatable between a generally horizontal and a generally vertical disposition, said latch means being disengaged from said second rod when the rotatable structure is in a vertical disposition, said second end of the slot contacting said second rod when the drive arm is being extended to transmit the motion of the drive arm to the rotatable structure through said first rod to thereby power drive the rotatable structure from its vertical to its horizontal position.

6. A yieldable multi-function linkage apparatus in accordance with claim 5 wherein said latch means includes a latch member pivotably connected to said movable connecting plate, said latch member having a notch for reception of said second rod in the engaged position of said latch means and having a center of gravity such that it is gravity biased to pivot to the disengaged position of said latch means as the rotatable structure approaches its vertical position and gravity biased to pivot to the engaged position of the latch means as the rotatable structure approaches its horizontal position by being driven by the drive arm.

7. A yieldable multi-function linkage apparatus in accordance with claim 4 wherein said slot has a sufficient length so that the second rod can move from the first end of said slot a sufficient distance to enable the rotatable structure to be manually moved from its vertical to its horizontal position.

8. A yieldable multi-function linkage apparatus in accordance with claim 3 wherein said second rod is made from a material having a lower yield strength than the materials used to make said first rod and said latch means whereby an excessive force applied to the rotatable structure can cause said second rod to yield structurally before said first rod or said latch means.

9. A yieldable multi-function linkage apparatus in accordance with claim 3 wherein said latch means includes a rotatable latch member whereby said rotatable latch member rotates between two positions corresponding to positions one and two of said lock means.

10. A yieldable multi-function linkage apparatus in accordance with claim 2 including a first plate for connection to the rotatable member, and wherein said fixed connecting plate includes a pair of said fixed connecting plates attached to and extending generally perpendicularly from said first plate in a spaced apart relationship to one another, and said movable connecting plate includes a pair of said movable connecting plates rotatably connected one each to said fixed connecting plates.

11. A yieldable multi-function linkage apparatus in accordance with claim 10 wherein said lock means automatically moves from position one to position two when said yieldable multi-function linkage apparatus is oriented such that said first plate is approximately 30 degrees from horizontal and moves from position two to position one when said yieldable multi-function linkage apparatus is oriented such that said first plate is greater than 30 degrees from the horizontal.

12. A yieldable multi-function linkage apparatus in accordance with claim 10 wherein said biasing means includes a coil spring and a stop, said spring positioned on said first rod between said first plate and said stop on said second end portion of said first rod.

13. A yieldable multi-function linkage apparatus for connecting a powered drive arm and a rotatable structure comprising:

a first plate for attachment to a rotatable structure;

a pair of connecting second plates attached to and extending perpendicularly from said first plate in a spaced apart relationship to one another;

a pair of connecting third plates rotatably attached one each to said second plates for attachment to said powered linkage arm; and holding means for yieldably and releasably connecting the rotatable structure and the third plates, said holding means including a biasing means for allowing the rotatable structure to move relative to the drive arm during other than normal driving operation when excessive force acts on the rotatable structure, said holding means further including latch means for selectively preventing said third plates from rotating relative to said second plates.

14. A yieldable multi-function linkage apparatus in accordance with claim 13 whereby the holding means includes first and second rods, said first rod having first and second ends, the first end of said first rod connected to said second rod intermediate its first and second ends, said first rod extending from its first end through a hole in said first plate and the rotatable structure, said holding means further including a rotatable latch member for selectively engaging said second rod, said rotatable latch member being rotatably connected to said third plates for rotation about an axis passing through said third plates.

15. A yieldable multi-function linkage apparatus in accordance with claim 14 wherein said biasing means includes a coil spring positioned on said first rod between said first plate and said second end of said first rod.

16. A yieldable multi-function linkage apparatus in accordance with claim 14 wherein said second rod is made from a material of yield strength less than the materials used to make said first rod and said rotatable member whereby an excessive force applied to the rotatable structure can cause said second rod to yield structurally before all other components except said coil spring.

17. A yieldable multi-function linkage apparatus in accordance with claim 14 wherein each of said third plates has a slot formed through it and a portion of said second rod passes through each slot, each slot having a first end and a second end, said second end being disposed further from the rotatable structure than said first end.

18. A yieldable multi-function linkage apparatus in accordance with claim 17 wherein the rotatable structure is rotatable between a generally horizontal and a generally vertical disposition, said latch member being disengaged from said second rod when the rotatable structure is in a vertical disposition, said second end of the slots contacting said second rod when the drive arm is being extended to transmit the motion of the drive arm to the rotatable structure through said first rod to thereby power drive the rotatable structure from its vertical disposition.

19. A yieldable multi-function linkage apparatus in accordance with claim 14 wherein each latch member has a notch for reception of a portion of said second rod in the engaged position of said latch means, said latch member having a center of gravity such that it is gravity biased to pivot said latch member to a position disengaged from said second rod as the rotatable structure approaches its vertical position and gravity biased to pivot said latch member to an engaged position with said second rod as the rotatable structure approaches its horizontal position by being driven by the drive arm.

20. A yieldable multi-function linkage apparatus in accordance with claim 17 or 19 wherein said slot has a sufficient length so that the second rod can move from the first end of said slot a sufficient distance to enable the rotatable structure to be manually moved from its vertical to its horizontal position.

21. A yieldable multi-function linkage apparatus in accordance with claim 20 wherein said latch member includes a pair of spaced arms each extending generally parallel to said third plate and a connecting member connecting said arms, each arm having a forward edge facing said first plate and a notch for reception of a portion of said second rod, said forward edge being slanted to form a camming surface to guide said second rod into said notches.

22. A yieldable multi-function linkage apparatus in accordance with claim 21 including a stop means carried by at least one of said third plates for preventing the rotation of said arms beyond a point where said forward edges can not guide said second rod into the notches formed in said arms.

23. A yieldable multi-function linkage apparatus in accordance with claim 13 wherein said latch means is gravitationally forced to disengage when the center of gravity of the rotatable structure is substantially vertically above the axis of said rotatable member.

24. A yieldable multi-function linkage apparatus in accordance with claim 12, 15 or 16 wherein said first rod is at least partially threaded and wherein at least two nuts are threaded onto said first rod, one of said nuts positioned on each side of the combination of said first plate and said coil spring.

25. A yieldable multi-function linkage apparatus for connecting a powered drive arm and rotatable structure comprising:

a first plate for attachment to a rotatable structure;

a pair of connecting second plates attached to and extending substantially perpendicularly from said first plate in a spaced apart relationship to one another;

a pair of connecting third plates rotatably attached one each to said second plates for attachment to a powered drive arm;

a first rod, at least partially threaded, having first and second ends with said first rod extending from its first end through a hole in said first plate;

a latch rotatably attached to said third plates, said latch including first, second and third members, said first and second members being held in a spaced relationship to one another by said third member, said third member being connected at one of its ends to said first member and at the other of its ends to said second member;

a second rod connected intermediate its first and second ends to said first rod, said second rod having length sufficient for engagement by said latch;

the rotational axis and the center of gravity of said latch located relative to each other and relative to said first plate such that said latch disengages from said second rod when said first plate is roughly 30 degrees from the horizontal;

a coil spring received about the portion of said first rod between said first plate and the second end of said first rod; and a pair of nuts threaded about said first rod with one on each side of the combination of said first plate and said spring.

26. A linkage apparatus for usage in a power-assisted support structure having a support member, a motor and a drive arm connected to said motor, said linkage apparatus comprising:

means for connecting said drive arm to said support member including means for pivoting said support member between first and second position, said connecting means including first and second rods, said first rod having a first end connected to said second rod, said first rod having a second end connected to a portion of said support member, and wherein said disengaging means includes latch means for reception of said second rod, said latch means engaging said second rod for powerassisted movement of said support member between said first and second positions, said latch means being disengaged from said second rod for manual movement of said support member between said first and second positions; and means for automatically disengaging with respect to pivotable movement said drive arm from said support member, said disengaging means being disengaged when said support structure is in one of said first and second positions;

whereby said support structure may be power-assisted or manually pivoted between said first and second positions.

27. Linkage apparatus in accordance with claim 26 wherein said latch means includes a pivotable latch member with a notch for reception of said second rod, said latch member having a center of gravity which causes said latch member to pivot and disengage as said support member approaches the first position and which causes said latch member to pivot and engage when said support member is driven by said drive arm to approach the second position.

28. Linkage apparatus in accordance with claim 26 wherein said connecting means includes means for biasing said support member with respect to said drive arm, said biasing means enabling said drive arm to be driven without transferring the motion of said support member to said drive arm when a force different from the force required to move said support member acts on said support member.

29. Linkage apparatus in accordance with claim 28 wherein said biasing means includes a spring received about the second end portion of said first rod, said spring being retained between said support member and the second end of said first rod.

* * * * *